United States Patent [19]

Jones et al.

[11] Patent Number: 4,528,837

[45] Date of Patent: Jul. 16, 1985

[54] BLIND FASTENER SETTING TOOL

[75] Inventors: James F. Jones; Ronald E. Ashby; Anthony P. Sinclair, all of Birmingham, England

[73] Assignee: USM Corporation, Farmington, Conn.

[21] Appl. No.: 578,425

[22] Filed: Feb. 9, 1984

[30] Foreign Application Priority Data

Feb. 15, 1983 [GB] United Kingdom ..... 8304113

[51] Int. Cl.[3] ..... B21D 31/00

[52] U.S. Cl. ..... 72/391; 29/526 A; 29/243.53; 29/414

[58] Field of Search ..... 72/391, 114, 453.17; 29/414, 417, 525, 526, 243.53

[56] References Cited

U.S. PATENT DOCUMENTS 2,438,201 3/1948 Buchet ..... 72/391

2,999,610 9/1961 Gapp ..... 72/391

4,178,669 12/1979 Hara et al. ..... 29/414

*Primary Examiner*—Daniel C. Crane

*Assistant Examiner*—David B. Jones

*Attorney, Agent, or Firm*—Alan N. McCartney

[57] ABSTRACT

A pliers-type tool for setting pull-type blind fasteners of a kind requiring the stem of the fastener to be severed after it has been pulled to set the fastener. A pair of blades mounted on pivotal holders arranged to be rocked by an actuating member of the tool after the stem has been pulled is provided. The actuating member is slideably mounted on the pull bar and a tooth of a latch engages both parts during an initial part of the setting stroke. When the fastener has been set the latch becomes disengaged from the pull bar while continuing to retract the actuating member. Such disengagement is controlled by a cam which is adjustable on the housing of the tool to vary the length of stroke of the pull bar in accordance with the thickness of workpiece in which the fastener is being set.

6 Claims, 3 Drawing Figures

BLIND FASTENER SETTING TOOL

BACKGROUND OF THE INVENTION (1) Field of the Invention

This invention is concerned with tools for setting plastic blind fasteners.

(2) Summary of the Prior Art

This invention relates to fasteners of the type which can be inserted through aligned holes in a workpiece until a head of a shank of the fastener engages the exposed side of the workpiece. There are means on the fastener for engaging the workpiece around the hole at the other side (i.e. the blind side) of the workpiece. By pulling the stem of the fastener which projects through said head while pushing on said head, and severing the stem adjacent the head, the fastener will be clamped to the workpiece.

The present invention provides an improved pliers-type tool for setting plastics blind fasteners of the type referred to which is robust, adjustable for a wide range of workpiece thicknesses, and of a design which lends itself to inexpensive manufacture. An example of a fastener and tool of this type is illustrated in U.S. Pat. No. 4,178,669.

SUMMARY OF THE INVENTION

The invention provides a pliers-type tool for setting plastics pull-type blind fasteners of the type referred to comprising a housing integral with a first lever of the tool, a reciprocable pull bar for engaging and pulling the stem of the fastener, means comprising a latch pivoted to a second lever of the tool engageable in a notch of the pull bar for reciprocating the pull bar. A pair of cutter blade holders are pivotally mounted on the housing for rocking about axes transverse to the direction of the reciprocation of the pull bar with forward ends thereof disposed so that cutter blades held thereby abut the head of a fastener for a setting operation. There is an actuating means for causing the cutter blade holders to rock after completion of an initial fastener-setting portion of the pulling stroke of the pull bar to bring the blades together to sever the fastener stem. The actuating means comprises an actuating member reciprocable with the pull bar and slideable relative thereto and having a slot through which the latch projects to engage the notch in the pull bar. The actuating means also includes shoulders inclined to the direction of reciprocation of the pull bar for engaging complementary faces on the cutter blade holders to cause them to rock as aforesaid. The tool further comprises a latch-retaining block mounted on the housing and having a linear cam face against which the latch bears to hold the latch in the notch of the pull bar during said initial part of the pulling stroke of said second lever to set the fastener and to allow the latch to release the pull bar but be retained in the slot of said actuating member during the remainder of the setting stroke to sever the fastener stem.

Preferably, in a tool as set out in the last preceding paragraph, means is provided for adjusting the position on the housing of the latch-retaining block in the direction of reciprocation of the pull bar to suit different thicknesses of workpiece, and such means may comprise a rotatable cam mounted on the housing and accommodated between pins projecting from the block and received in slots in the housing.

The actuating member of a tool in accordance with the invention may be a sleeve in which the pull bar is slideable. The pull bar may have shoulders to engage the underside of a head of the stem of a fastener, and these shoulders may lie parallel to the cutter blades so that a fastener can be introduced through an opening at one side of the housing.

BRIEF DESCRIPTION OF THE DRAWINGS

This illustrative tool has been selected for description by way of example and not of limitation of the invention.

In the accompanying drawings

DESCRIPTION OF THE PREFERRED EMBODIMENT

Figure 1:
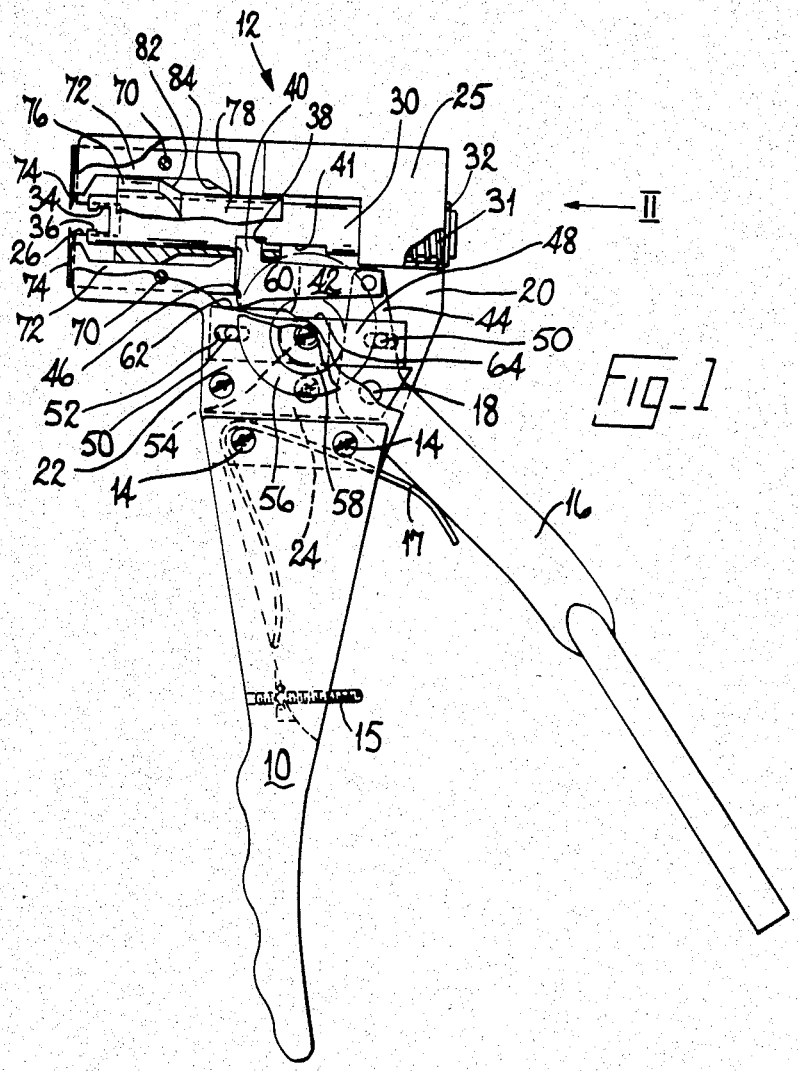
FIG. 1 is a side view, partly in section, of the illustrative tool in an "at rest" condition ready to receive a fastener.
Figure 2:
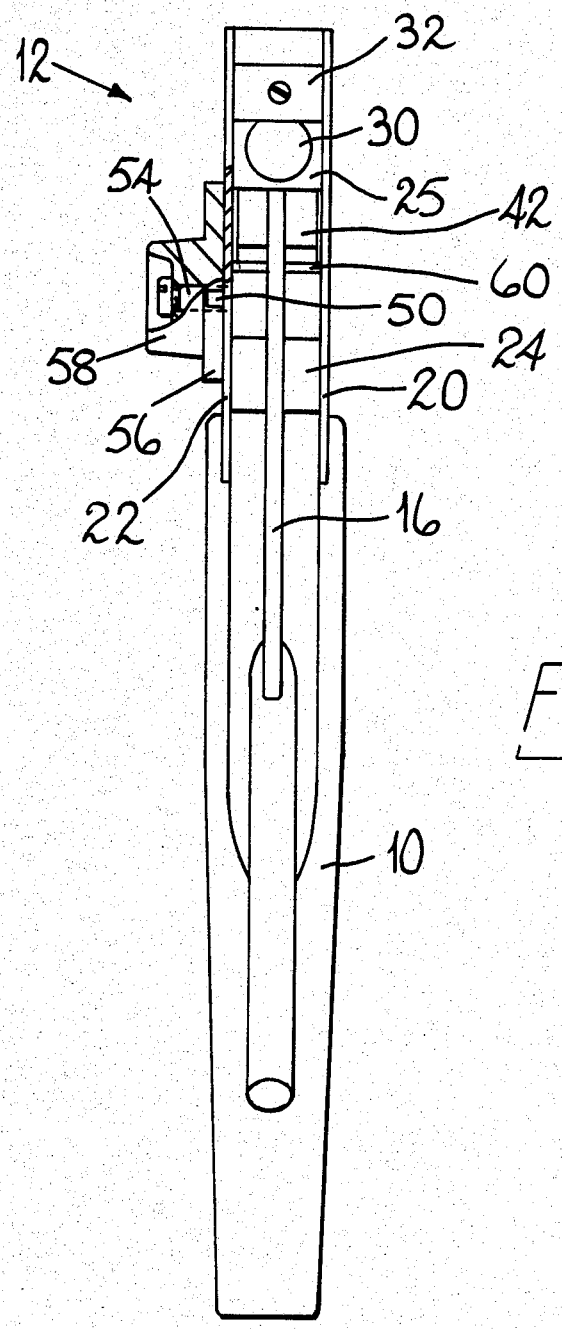
FIG. 2 is a view of the illustrative tool as seen in the direction of the arrow II in FIG. 1.

The illustrative tool is of the pliers-type and comprises a first lever 10 integral with a housing 12 to which it is secured by bolts 14. A second lever 16 is pivoted to the housing 12 at 18; it is convenient to regard the lever 10 as the fixed one and the lever 16 as the movable one. An adjustable stop 15 on the lever 10 limits closing of the lever; a return spring 17 urges them apart. The housing comprises parallel side plates 20, 22 bolted together with intermediate spacers 24, 25. For economy, the housing and fixed lever may be cast as one piece. The side plates have openings 26 for the introduction and ejection of fasteners as will hereinafter appear, and to separate a fastener from a strip if it has not been detached before introduction to the tool.

Figure 3:
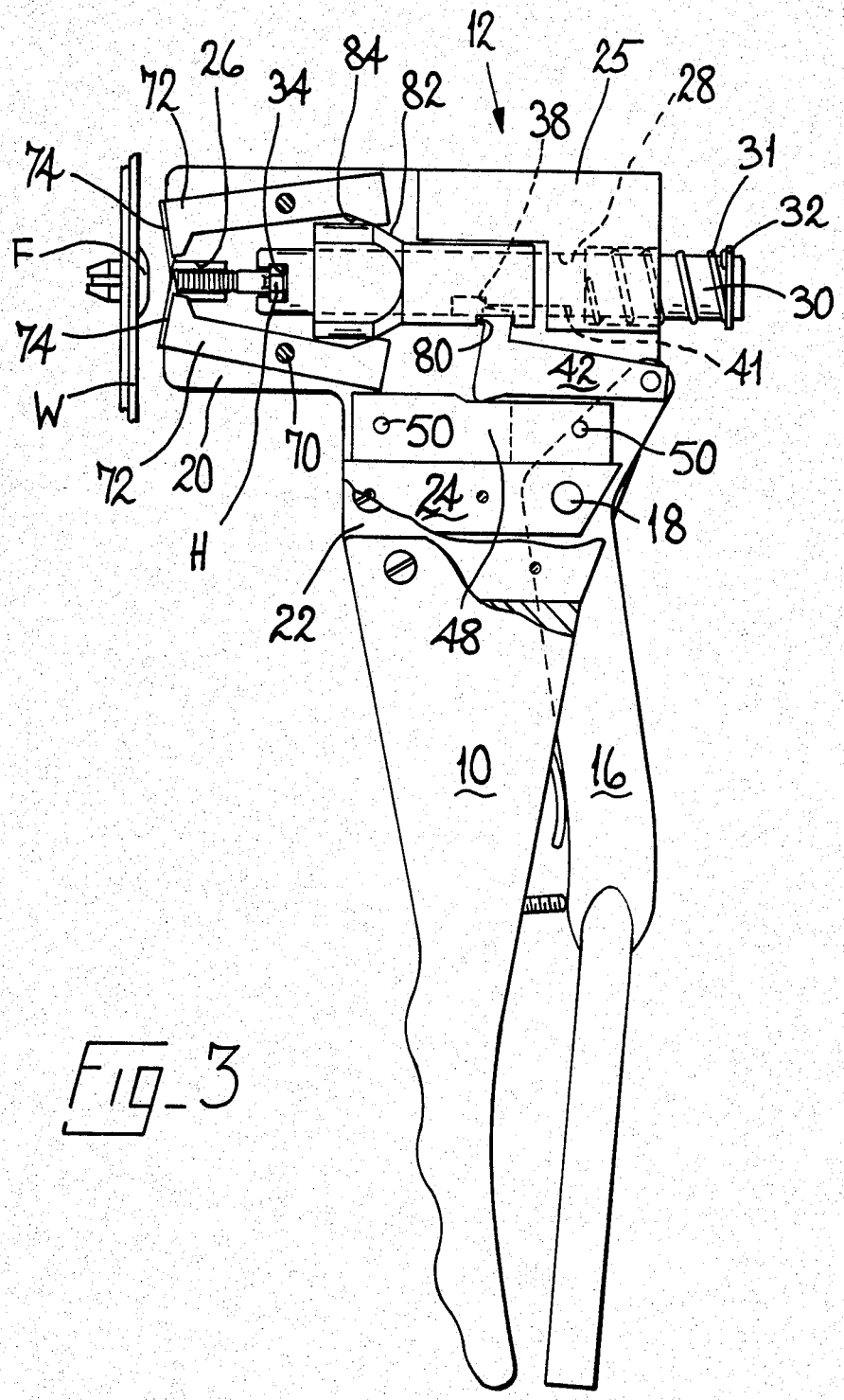
FIG. 3 is a view similar to FIG. 1 but depicting the illustrative tool at the end of a fastener setting operation.

One of the spacers, 25, has a bore 28 in which a cylindrical pull bar 30 is slideably mounted. A rear end portion of the pull bar 30 is surrounded by a compression spring 31 which bears at its forward end on an annular shoulder of the housing and at its rear on a split washer 32 encircling an annular groove in the push bar. The bar is thus at all times urged rearwardly by the spring. (In FIG. 3, the tool is shown with the lever 16 closed on the lever 10 immediately after the fastener stem has broken, and before the spring 31 has asserted itself.)

At its front end, the pull bar 30 has a T-shaped slot 34 running transversely through it for the reception of a head H of a fastener F (FIG. 3) under which shoulders 36 (FIG. 1) of the pull bar can bear. At one side, facing the levers 10, 16, the pull bar 30 has a notch 38 into which is received a tooth 40 of a latch 42 pivoted to an arm 44 of the lever 16. A heel 46 of the latch 42 is backed up by a linear cam surface of a latch-retaining block 48 mounted between the plates 20, 22 of the housing 12. Two pins 50 of the block 48 project through aligned slots 52, parallel to the pull bar 30, in the plate 22. On a stud 54 projecting from the plate 22 mid-way between the slots 52 is rotatably mounted an eccentric disc 56 with an integral knob 58 by which it can be turned. The diameter of the disc 56 fits in the space between the pins 50 so that rotation of the disc adjusts the position of the block 48 along the slots. The cam surface is linear, running lengthwise parallel to the pull bar 30, and has in it an inclined step 60 which separates first and second portions 62, 64 respectively of the surface. The distances of the portions 62, 64 from the pull bar 30 are such that with the heel 46 of the latch riding on the first portion 62, the tooth 40 is in the notch 38, but when the heel 46 slides down the step 62 the tooth 40 is withdrawn sufficiently far from the bottom of the notch to ride along a plane ledge 41 provided by cutting off a shallow sector of the pull bar 30 rearward of the notch 38. Rotation of the knob 58, by moving the block 48, adjusts the length of stroke of the pull bar 30 before it is thus disengaged by the latch when a pulling stroke is imparted to it by the lever 16.

Pivoted to the housing by transverse pins 70 mounted in the plates 20, 22 is a pair of cutting blade holders 72 each of which carries at a forward end a blade 74. Inner sides of the holders are relieved to accommodate a wide portion 76 of an actuating member 78 slideably mounted on the pull bar 30. The portion 76 has flat sides adjacent plates 20, 22 to prevent it from turning. The member 78 has a tubular extension in which is a slot 80 (FIG. 3) to accommodate the tooth 40 of the latch 42 and allow it to engage the notch 38 of the pull bar.

Between the wide portion 76 and a tubular extension of the member 78 are frusto-conical surfaces 82 of the pull bar 30 and engageable by flat inclined faces 84 on the inside wall of the holders 72. Thus, when the latch 42 releases the pull bar 30 in a pulling stroke of the lever 16, the tooth remains in the slot 80 of the member 78 and continues to retract it, the surfaces 82 when they reach the faces 84 then causing the holders 72 to rock and bring the blades 74 together.

In the operation of the tool, the knob 58 may be turned to adjust the position of the step 60 as appropriate for the thickness of workpiece (and consequently the length of setting stroke of the pull bar) in which the fastener is to be set. The disc 56 may conveniently be graduated with suitable markings for this purpose. The head of a stem of a fastener F (FIG. 3) is introduced transversely to the T-slot 34 in the pull bar 30, the slot being suitably dimensioned so the shoulders 36 underlie the head of the fastener stem. The shank of the fastener is then introduced into aligned holes in the workpiece W until the shank head engages the exposed surface, and the levers 10, 16 are squeezed. The open blades 74 now bear on the shank head of the fastener and hold it against the workpiece while the pull bar 30 retracts, being pulled by the lever arm 44 and latch 42 until the workpiece is clamped by the set fastener. The heel 46 of the latch will now have reached the step 60 (if the knob 58 has been properly adjusted) so that the tooth 40 slips out of the notch 38 (the engaging surface of the tooth may be slightly chamfered to facilitate disengagement) and the latch continues to retract the actuating member 78, the tooth riding along the ledge 41.

Next, the surfaces 82 reach the faces 84 and, continuing to be pulled by the latch, spread the faces 84 apart to bring the blades 74 together to sever the fastener stem flush with the shank head. The detached part of the fastener will be ejected through one of the openings 26 when the pull bar 30 is restored to its forward position and the next fastener is introduced. Restoration of the pull bar to its forward position will occur, on release of the levers 10, 16 under the influence of the return spring 17, the tooth 40 ensuring such restoration by engagement with the front wall 43 of the notch 38.

We claim:

1. A pliers-type tool for setting plastic pull type blind fasteners comprising: a housing, a first lever integral with said housing, a reciprocable pull bar in said housing for engaging and pulling the stem of the fastener, a second lever pivoted to said first lever, means comprising a latch pivoted to said second lever of the tool engageable in a notch of the pull bar for reciprocating the pull bar, a pair of cutter blade holders pivotally mounted on the housing for rocking about axes transverse to the direction of the reciprocation of the pull bar with forward ends thereof disposed so that cutter blades held thereby abut the stem of a fastener for a severing operation, and actuating means for causing the cutter blade holders to rock after completion of an initial fastener-setting portion of the pulling stroke of the pull bar to bring the blades together to sever the fastener stem, the actuating means comprising an actuating member reciprocable with the pull bar and slideable relative thereto and having a slot through which the latch projects to engage the notch in the pull bar and shoulders inclined to the direction of reciprocation of the pull bar for engaging complementary faces on the cutter blade holders to cause them to rock as aforesaid, the tool further comprising a latch-retaining block mounted on the housing and having a linear cam face against which the latch bears to hold the latch in the notch of the pull bar during said initial part of the pulling stroke of said second lever to set the fastener and to allow the latch to release the pull bar but be retained in the slot of said actuating member during the remainder of the setting stroke to sever the fastener stem.

2. A tool according to claim 1 comprising means for adjusting the position on the housing of the latch-retaining block in the direction of reciprocation of the pull bar to suit different thicknesses of workpiece.

3. A tool according to claim 2 in which the means for adjusting said position of the latch-retaining block comprises a rotatable cam mounted on the housing and accommodated between pins projecting from the block and received in slots in the housing.

4. A tool according to claim 3 in which the actuating member is a sleeve in which the pull bar is slideable.

5. A tool according to claim 4 in which the pull bar has pulling shoulders to engage the underside of a head of the stem of a fastener.

6. A tool according to claim 5 in which the pulling shoulders lie parallel to the cutter blades so that a fastener can be introduced through an opening at one side of the housing.

* * * * *